US006155401A

United States Patent [19]

Lunardi et al.

[11] Patent Number: 6,155,401

[45] Date of Patent: Dec. 5, 2000

[54] DRIVE FOR AN ESCALATOR

[75] Inventors: Gerhard Lunardi, Vienna; Robert Ulrich, Bruckneudorf, both of Austria

[73] Assignee: Inventio AG, Hergiswil, Switzerland

[21] Appl. No.: 09/239,201

[22] Filed: Jan. 28, 1999

[30] Foreign Application Priority Data

Feb. 13, 1998 [EP] European Pat. Off. ..... 98810115

[51] Int. Cl.[7] ..... B66B 23/02

[52] U.S. Cl. ..... 198/330; 198/322; 198/810.01

[58] Field of Search ..... 198/321–323, 198/330, 810.01, 834, 835

[56] References Cited

U.S. PATENT DOCUMENTS

| | | | |
|---|---|---|---|
| 4,775,044 | 10/1988 | Hofling | 198/330 |
| 5,224,580 | 7/1993 | Nurnberg et al. | 198/330 |

FOREIGN PATENT DOCUMENTS

| | | | |
|---|---|---|---|
| 3526905 | 2/1987 | Germany | B66B 23/02 |
| 1586988 | 8/1990 | U.S.S.R. | 198/330 |

OTHER PUBLICATIONS

Patent Abstracts of Japan pub. No. 04133991 of Jul. 5, 1992 "Method and Device for Driving Man–Conveyor".

*Primary Examiner*—Joseph E. Valenza
*Attorney, Agent, or Firm*—Schweitzer Cornman Gross & Bondell LLP

[57] ABSTRACT

A drive for an escalator is installed on one or both sides of the escalator at the lower and/or upper end and comprises one to several identically constructed drive units, which are arranged and distributed about the circumference of a main drive wheel. The drive units can be flange-mounted in either a longitudinal or transverse direction to the direction of travel of the escalator on a common main gear housing which can be identical for the support of one or more drive units. The operation of the motors of the drive units are controlled by way of a common frequency-setting device. A control and regulating unit processes input data into control and regulating data for the frequency-setting device, a relay control and optical signals and illumination for the escalator. The individual drive units are switched in or out according to the actual power requirements of the escalator during operation.

5 Claims, 3 Drawing Sheets

DRIVE FOR AN ESCALATOR

The present invention concerns a drive for an escalator, which drives the stair belt and is arranged on one or both sides of the escalator at the upper and/or the lower end thereof, wherein the drive comprises a main drive wheel and at least one motor with gear and brake components.

BACKGROUND OF THE INVENTION

Different dispositions and constructional principles are known for escalator drives. Since the drive must be designed for the maximally occurring load, a relatively large and strongly dimensioned motor with a corresponding gear is necessary. Poor efficiency at the mostly prevailing partial load and the large installation volume in the case of limited space availability within an escalator construction are disadvantages of such a drive.

These disadvantages are present to a lesser degree or not at all with multi-motor drives. Such a drive for escalators and walkways, which comprises two individual drives or two twin drives, the output gearwheels of which drive the stair chain or the plate chain and, by way of an additional gear, the handrail, is known from DE 35 26 905.

Such a construction is executed in different variants and correspondingly comprises a number of different gears and gear housings for the stair chain drive or the plate chain drive. Furthermore, the individual drives are equipped with planetary gears, which causes relatively high costs.

The object of the present invention is to create an improved multi-motor drive for escalators, which can be implemented at favorable costs, which may be built up in a modular manner, and which covers a usual performance range.

BRIEF DESCRIPTION OF THE INVENTION

The drive according to the present invention distinguishes itself by several constructionally identical drive units being mountable distributed at the circumference of a main drive wheel, whereby the main drive wheel or its toothing need be dimensioned only for loading by a single drive unit. The main drive wheel itself thus can have a smaller width, which is of great advantage for the accommodation of the drive parts in the case of an escalator.

The drive units, in a number corresponding with power requirements, may be flange-mounted to a main gear housing identical for all performance classes. This simplifies the production process for the entire constructional series, reduces the inventory and facilitates maintenance and repairs.

The drive units are provided with torque transmitters and/or rotational speed transmitters for recognition of their mechanical loading.

Each of the drive units can furthermore be provided with a clutch which makes a selectable switching-in or switching-out of a drive unit possible.

The drive further comprises a frequency-setting device which is common to all drive units and by means of which different speeds can be set and which also serves as a starting aid. A control and regulating unit produces corresponding control and regulating commands by the processing of incoming data. The control and regulating unit causes the switching-in and switching-out of individual drive units on the basis of actual load data from the torque transmitters, which helps to improve the electrical and mechanical efficiency and thus also reduces the energy consumption.

The use of polyphase alternating current squirrel-cage motors of variable frequency and their associated control has the advantage that high torques can be produced at low rotational speeds.

BRIEF DESCRIPTION OF THE DRAWINGS

The invention is explained more closely in the following with the aid of an illustrative example of an embodiment thereof and is illustrated in the accompanying drawings, wherein.

DETAILED DESCRIPTION OF THE INVENTION

Figure 1:
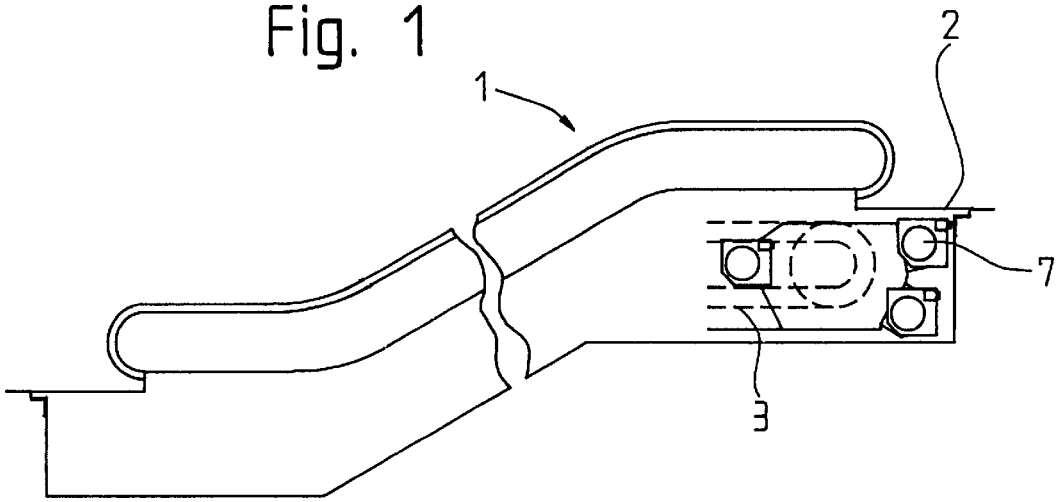
FIG. 1 shows an escalator with a drive according to the invention at the upper end of the escalator.

FIG. 1 shows an escalator 1 with an upper end 2, below which drive units denoted by 7 and a part of a stair chain 3 are visible.

Figure 2:
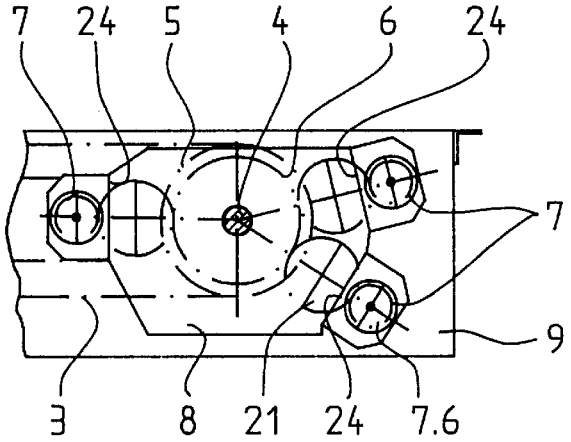
FIG. 2 shows the drive with drive units flange-mounted on a main gear transversely to the direction of travel of the escalator.

FIG. 2 shows the details of a drive, which is installed within a carrying structure 9 at the upper end 2 of the escalator 1. Three identically constructed drive units 7 drive a toothed main drive wheel 6 by way of an output gearwheel 7.6 and an intermediate gearwheel 21, and are arranged and distributed about the circumference of the main drive wheel 6. The main drive wheel 6, together with a stair chain wheel 5, are fastened on the main shaft 4 of the drive. The drive units 7 are firmly connected to a main gear housing 8 at three planar flange-connecting openings 24 formed for this purpose. When less than three drive units 7 are needed, the unused flange-connecting opening 24 may be closed by a cover and the associated intermediate gearwheel 21 is not inserted. With this construction, the same main gear housing 8 can always be used for one, two or three needed drive units 7. The axles of the drive units 7 are arranged transversely to the direction of movement of the escalator 1, which yields the advantage of a short machine room.

Figure 3:
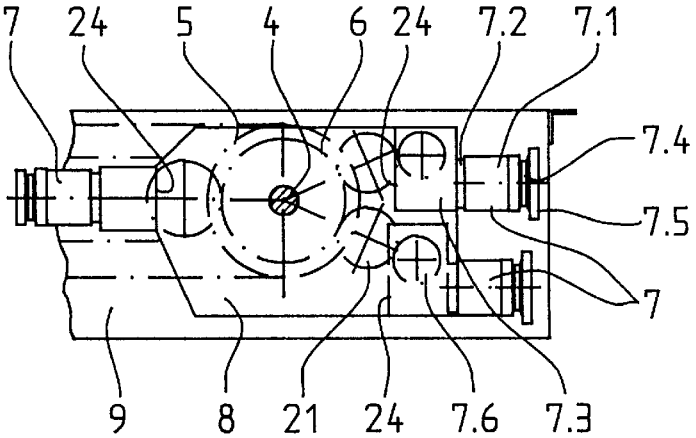
FIG. 3 shows the drive with drive units flange-mounted on a main gear longitudinally of the direction of travel of the escalator.

As example of a variant, FIG. 3 shows an arrangement of the drive units 7 parallel to the direction of movement of the escalator 1. In this manner of arrangement, the drive units 7 additionally comprise a bevel gear 7.3. Motor 7.1, clutch 7.2, brake 7.4, flywheel 7.5 and the output gearwheel 7.6, which are otherwise constructionally identical with and incorporated in the drive units 7 of FIG. 2, are present for each drive unit 7. The main gear housing 8 is likewise always the same for one, two or three drive units 7 and unused flange-connecting openings 24 can likewise be covered by a cover.

Figure 4:
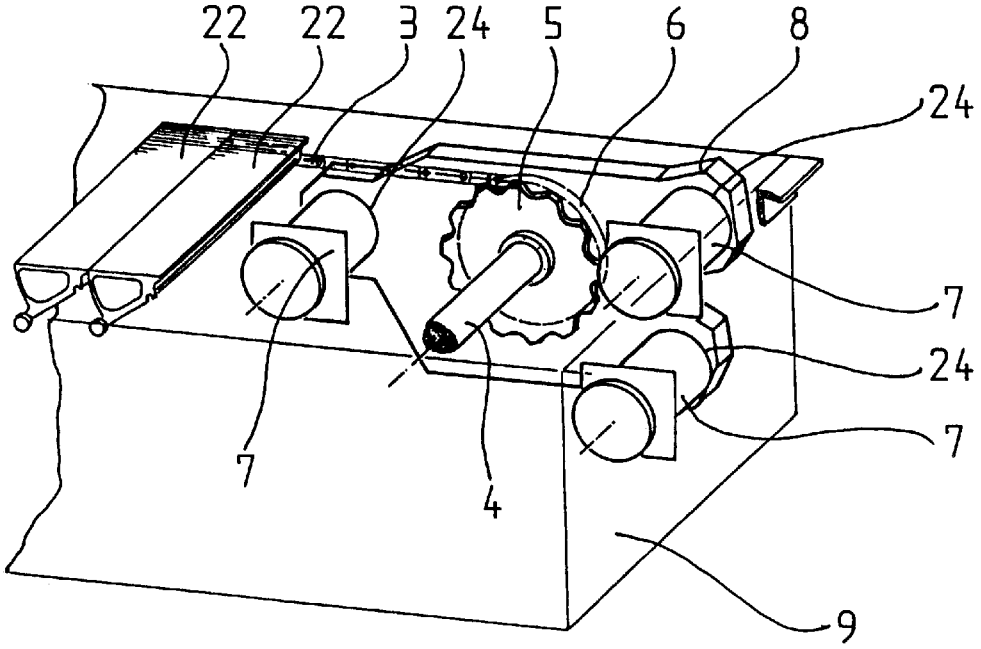
FIG. 4 shows a three-dimensional illustration of the drive arrangement according to FIG. 2.

FIG. 4 is a spatial illustration of the drive according to FIG. 2 within the carrying structure 9 of the escalator 1. Two stair elements 22 are illustrated in addition to the elements shown in the preceding illustrations.

Figure 5:
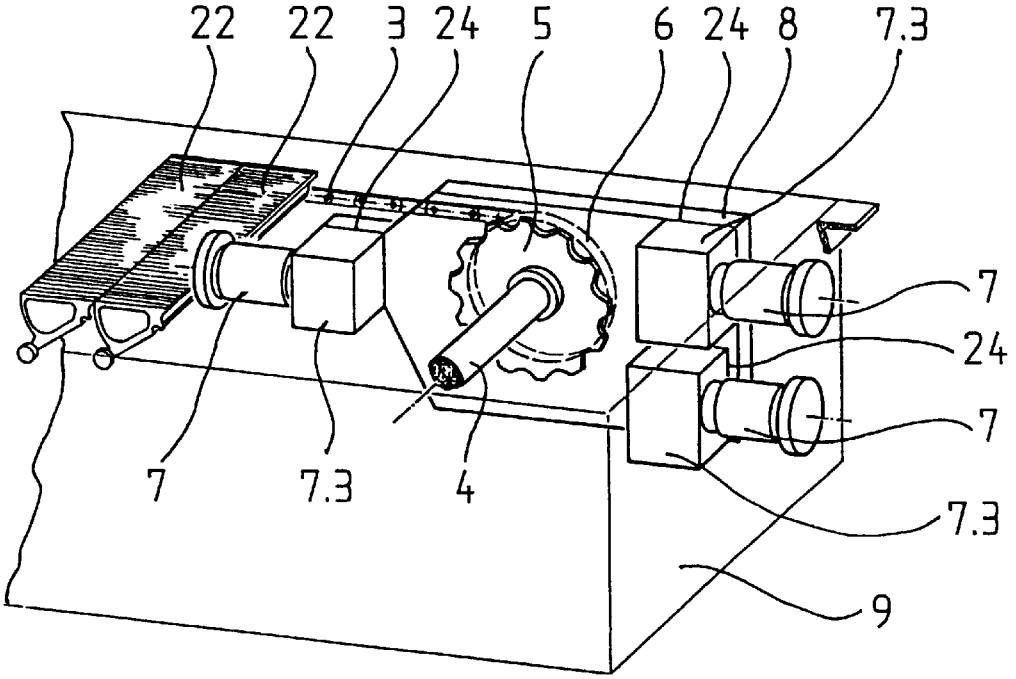
FIG. 5 shows a three-dimensional illustration of the drive arrangement according to FIG. 3.

FIG. 5 is a similar spatial illustration of the drive according to FIG. 3 within the carrying structure 9 of escalator 1. The two stair elements 22 are likewise additionally shown.

Figure 6:
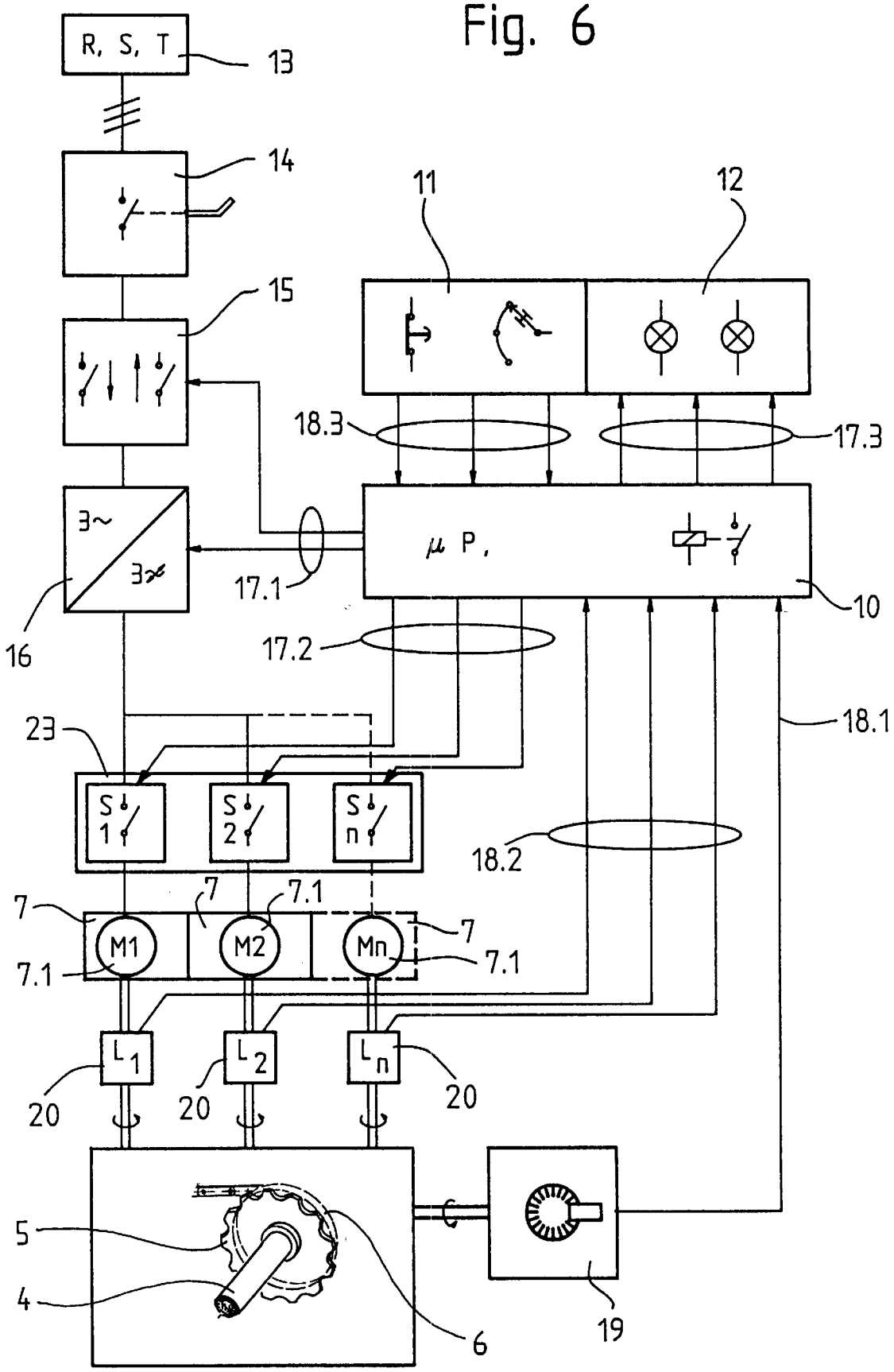
FIG. 6 shows a block schematic diagram and functional diagram of the drive with all associated components.

The function and operation of the multi-motor drive according to the invention is to be explained more closely in the following by reference to FIG. 6. The current supply of the drive takes place as usual from local three-phase current mains 13 with phases R, S and T which are led to a main switch 14. Following thereon, the entire drive is connected through a main relay or several relays 15. There then follows a frequency-setting device 16, which by way of a relay control 23 with the relays S1, S2 to Sn feeds the motors 7.1 (M1, M2 to Mn) of the drive modules 7 at a variable frequency current and direction of rotation as provided by the frequency-setting device 16. The motors M1, M2 to Mn are, as already shown and described in the preceding, operatively connected with the main drive wheel 6 by way of gears 7.3 and output gearwheels 7.6 and intermediate gearwheels 21, which are not further illustrated here. Torque transmitters 20 (L1, L2 to Ln) for the purpose of the measurement of the actual mechanical loading of the motors M1, M2 to Mn are installed at a suitable place in the transmission between the motors M1, M2 to Mn as known in the art. The main gear wheel 6 drives a speed transmitter 19 by way of an appropriate known transmission, which similarly is not more closely illustrated.

A control and regulating unit 10 contains microprocessor and relay control components, as well as signal and data inputs and outputs. First input data line 18.1 supplies speed values from the speed transmitter 19, which are fed as actual values to an internal regulating section. The second group of input data lines 18.2 provide measurement values from the torque transmitters 20 and, through appropriate processing, cause the switching-in and switching-out of individual drive modules 7. A third group of input data lines 18.3 supplies data from transmitters 11, which essentially concern control safety contacts and mode of operation switches. A first group of output data lines 17.1 leads to the relays 15 and to the frequency-setting device 16. A second group of output data lines 17.2 contain control signals for the relay control 23, and the third group of output data lines 17.3 provides the data to control optical signals and illumination 12.

The multi-motor drive according to the invention functions as following:

During starting-up of the escalator 1, the relay 15 for the drive is switched on, the frequency-setting device 16 is run up and at least one drive module 7 is switched on by way of the relay control 23 by the control and regulating unit 10 according to the choice of direction and a start-up program. On reaching the target speed, the drive regulation in the control and regulating unit 10 holds the speed of travel of the escalator 1 constant within close limits independently of the load. During the now following operation of the escalator 1, the input data lines 18.2 from the torque transmitters 20 supply information about the mechanical loading of the switched-in drive modules 7 (motors M1, M2 to Mn).

In the case of low or no loading by transported persons, the drive power of the first motor M1 may suffice, and the further motors M2 to Mn remain switched off. If a full loading with a tendency to lasting overload is signalled by the torque transmitter L1, the next motor M2 is switched on after a defined time. The signals from the two torque transmitters L1 and L2 are now monitored in the control and regulating unit 10 and a further, not illustrated motor M3 may be switched in according to analog criteria when the load limit values of the motors M1 and M2 are exceeded. The third motor, denoted by Mn in the illustration, is to indicate that, in principle, a greater number of drive modules 7 can be provided. For practical and economic reasons, however, the number of drive modules 7 will probably remain restricted to three or at most four.

The procedure is reversed when the mechanical loading drops. The no longer needed motors 7.1 are then switched off in the sequence beginning with the motor Mn switched on last. If a uniform wear of the drive modules 7 is desired, this can be taken into consideration by way of an additional measurement of the switched-on times of the individual drive modules 7 and the individual drive modules 7 can thus be switched on and off selectably and not according to an always identical sequence.

As already mentioned, the number of the drive modules 7 is not limited to the illustrated three items. Drive modules 7 produced in large quantities can be very favorable in price, so that it could be feasible to provide a greater number, for example 4 to 6, drive modules 7. With appropriately adapted control programs in the control and regulating unit 10, the greater amount of data resulting therefrom can be processed without problems.

The use of direct current motors for the drive modules 7 is also possible in principle with appropriately-adapted control and regulating techniques as known in the art. Alternating current motors with squirrel cage armatures are preferably used because of their simple mode of construction and ease of service. Moreover, efficient and likewise cheap frequency-setting devices or frequency converters are available.

Normal spur gearwheels, by means of which an optimum mechanical efficiency is achieved, may be used for the drive arrangement according to FIG. 2. Cone wheel gears, by means of which a practically equal efficiency is achieved by comparison with spur gearwheels, are advantageously used as bevel gears 7.3 for the drive arrangement according to FIG. 3.

The main gear housing 8 can be so constructed that both drive arrangements, those according to FIG. 2 as well as those according to FIG. 3, can be realized. The main drive housing 8 then correspondingly has twice as many flange-connecting openings 24. The intermediate gearwheels 21 can be the same at the same position for both drive arrangements.

The drive arrangement according to the invention can also be used for other kinds of conveying equipment, for example for walkways and mercalators in horizontal and oblique construction.

We claim:

1. A drive for an escalator for driving a stair chain and arranged on at least one side of an escalator at an end thereof, the drive comprising a main drive wheel, characterized in that several connecting openings are arranged in a main gear housing and at the circumference of the main drive wheel, and at least one drive unit are mountable to the connecting openings and are in drive connection with the main drive wheel, wherein the connecting openings at the main gear housing are formed and arrayed to be coverable when a drive unit is not mounted thereto, each of said drive units comprising a motor, gears for coupling said motor to said main drive wheel, and a brake.

2. The drive according to claim 1, characterized in that the drive units each include a clutch.

3. The drive according to claim 1, characterized in that the drive units each include a torque transmitter.

4. The drive according to claim 1, 2 or 3, characterized in that a common frequency-setting device is provided for the feed and control of each of the motors of the drive units.

5. The drive according to claim 4, further comprising data, speed and torque transmitters associated with each of said drive units, and a common control and regulating unit for the processing of data from said transmitters into output data for the control of relays, the frequency-setting device, optical signals, illumination and a relay control.

* * * * *